US010123120B2

(12) United States Patent
Mentz

(10) Patent No.: US 10,123,120 B2
(45) Date of Patent: Nov. 6, 2018

(54) METHOD AND APPARATUS FOR PROVIDING 3D SOUND FOR SURROUND SOUND CONFIGURATIONS

(71) Applicant: BACCH Laboratories, Inc., Princeton, NJ (US)

(72) Inventor: James Mentz, Gainesville, FL (US)

(73) Assignee: BACCH LABORATORIES, INC., Gainesville, FL (US)

( * ) Notice: Subject to any disclaimer, the term of this patent is extended or adjusted under 35 U.S.C. 154(b) by 0 days.

(21) Appl. No.: 15/460,092

(22) Filed: Mar. 15, 2017

(65) Prior Publication Data

US 2017/0272863 A1 Sep. 21, 2017

Related U.S. Application Data

(60) Provisional application No. 62/308,661, filed on Mar. 15, 2016.

(51) Int. Cl.

| | |
|---|---|
| ***H04R 3/14*** | (2006.01) |
| ***H04R 5/02*** | (2006.01) |
| ***H04R 5/04*** | (2006.01) |
| ***H04S 5/00*** | (2006.01) |

(52) U.S. Cl.

CPC ..... *H04R 5/02* (2013.01); *H04R 5/04* (2013.01); *H04S 5/005* (2013.01); *H04R 2205/024* (2013.01); *H04R 2499/13* (2013.01); *H04S 2400/05* (2013.01); *H04S 2400/09* (2013.01); *H04S 2420/01* (2013.01); *H04S 2420/11* (2013.01)

(58) Field of Classification Search

CPC ..... H04S 2420/01; H04S 1/00; H04S 5/02
USPC ..... 381/99
See application file for complete search history.

(56) References Cited

U.S. PATENT DOCUMENTS

| | | | | |
|---|---|---|---|---|
| 6,577,736 B1 * | 6/2003 | Clemow | ..... | H04R 5/02 381/17 |
| 2005/0078833 A1 * | 4/2005 | Hess | ..... | G01S 3/8083 381/26 |
| 2016/0150339 A1 * | 5/2016 | Choueiri | ..... | H04S 1/005 381/309 |

* cited by examiner

*Primary Examiner* — George C Monikang
(74) *Attorney, Agent, or Firm* — Saliwanchik, Lloyd & Eisenschenk

(57) ABSTRACT

A system for listening to binaural audio through a plurality of speakers having at least two pair of speakers, incorporating applying at least two Crosstalk Cancellation Filter to a corresponding at least two binaural signals to create a corresponding at least two pair of speaker signals, and inputting the at least two pairs of speakers signals to a corresponding at least two pairs of speakers of a plurality of speakers. The invention also relates to a system and method for listening to binaural audio through a plurality of speakers by dividing the speakers into groups, generating a Crosstalk Cancellation Filter for each group, and distributing the binaural audio among the speaker groups. The invention also relates to a system for placing a binaural audio signal onto a plurality of pairs of cross talk cancelled loudspeakers.

20 Claims, 12 Drawing Sheets

METHOD AND APPARATUS FOR PROVIDING 3D SOUND FOR SURROUND SOUND CONFIGURATIONS

CROSS-REFERENCE TO RELATED APPLICATION

The present application claims the benefit of U.S. Provisional Application Ser. No. 62/308,661, filed Mar. 15, 2016, which is hereby incorporated by reference herein in its entirety, including any figures, tables, or drawings.

BACKGROUND

Surround Sound (e.g., ATSC A/52 5.1) can only place sound at 5 places (5.1) (FIG. 1), place sound at 7 places (7.1), or place sound at on the line between those places (panning). 3D Sound (e.g., BACCH and other cross-talk cancellers) allows Binaural Audio with 2 Loudspeakers (B2L), such that two speakers can place a sound anywhere in 3D space. Accordingly, when using 3D Sound, the other 3/5 speakers in 5.1/7.1 are not needed to place a sound in 3D space.

However, a large number of console gamers have 5.1 surround sound setups. These gamers currently get more value out of 5 speakers than they do out of 2 speakers. These gamers would like to continue to use 5 speakers, and get more value out of 5 speakers than they do out of 2 speakers.

Accordingly, there is a need to accomplish the 3D effects of 3D Sound while shaking more than two speakers, and preferable all 5/7 speakers. Preferably, the shaking of all 5/7 speakers is accomplished in a manner that actually makes the 5/7 speaker solution sound better.

Listening to Binaural Audio from signals from cross-talk canceller inputted to two (XTC) Speakers in front of the listener (FIG. 2) is desirable. With Headphones, if HRTF mismatch between listener and recording occurs, the sound collapses to inside the listener's head. With BACCH-SP, and two XTC speakers in front of the listener (FIG. 2), if HRTF mismatch between listener and recording occurs, the sound collapses to the stereo pan (speaker locations). The sound is still outside the listener's head and in front of the listener, the correct position for on-screen action.

Listening to binaural Audio with two XTC Speakers behind the listener (FIG. 3) is also enjoyable (e.g., in an automobile, in a video gaming chair, and/or speakers in a room). Again, with Headphones, if HRTF mismatch between listener and recording occurs, the sound collapses to inside the listener's head. With BACCH-SP, and the XTC speakers behind the listener, if HRTF mismatch between listener and recording occurs, the sound collapses to the stereo pan (speaker locations). The pair of rear speakers can be crosstalk cancelled and used to create the sound behind the listener.

One of the reasons for imperfection in the perception of the placement of a sound in 3 d space when using 5.1 or 7.1 setup can be described by comparing a Typical set-up (typical) (FIG. 4) with the Coherent set-up (perfect) 5.1 (FIG. 5) are as follows:

Typical 5.1 (FIG. 4): The Left and Right speakers are the only speakers with full size, full power, and full range; other channels (speakers) are special satellites and should be used for special effects; the speakers are positioned at non-uniform distances, e.g. the speakers are arranged in a square; when multiple listeners are in the space, most of listeners are off-center; the Left-Right Speaker angle about +/−30 degrees; the distance from listener to speakers is undefined; and/or the distance from the microphone to the source might or might not meet P&E recommendations of 6.5-7.5 feet.

Coherent 5.1 (FIG. 5): Identical Speakers are used. Identical Amplification is used. Identical Response of speakers is accomplished. Uniform distances are implemented. The speakers are arranged in a circle. There is a single listener in the center. The Left-Right speaker angle is exactly +/−22.5 or +/−30 degrees. The distance from listener to speakers meets P&E recommendations of 6.5-7.5 feet. The distance from microphone to source meets P&E recommendations of 6.5-7.5 feet.

Even though experts argue that the assumption that sound is always superimposable is not true, relying on this assumption typically works.

DETAILED DISCLOSURE

Figure 6:
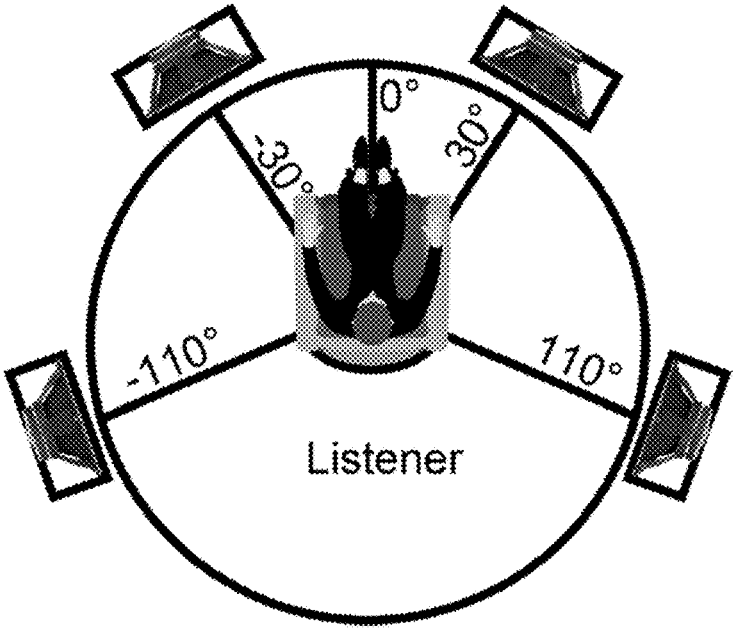
FIG. 6 shows an embodiment, where 3D Sounds (e.g., BACCH-SP) in the front hemisphere are sent to front XTC speakers of a 5.1 speaker set-up, and 3D Sounds in the rear hemisphere are sent to the rear XTC speakers of the 5.1 speaker set-up.

In an embodiment, 3D Sounds (e.g., BACCH-SP) in the front hemisphere are sent to front XTC speakers of a 5.1 speaker set-up (FIG. 6) and 3D Sounds in the rear hemisphere are sent to the rear XTC speakers of the 5.1 speaker set-up. Since with BACCH-SP, when HRTF mismatch between listener and recording occurs the sound collapses to the speaker locations, having physical rear speakers in the 5.1/7.1 speaker set-up assures that rear sounds stay in the rear, giving value to a 5.1 speaker setup in a 3D world.

Crosstalk cancelling filters (XTC) can be generated in a Normal fashion such that sounds placed anywhere are of equal spectral flatness. Alternatively, XTC filters can be generated in a Narrow fashion such that a sound that has an at least 95%, at least 96%, at least 97%, at least 98%, at least 99%, 100%, 95-96%, 96-97%, 97-98%, 98-99%, 99-100%, 95-100%, 96-100%, 97-100%, 98-100%, and/or 99-100% correlation between Left and Right—as in a mono source placed dead center—will appear to be 3-4 dB lower than expected. This is referred to as Narrow filter or an XTC filter with a center hole. A Narrow filter can be intentionally generated so that the traditional Center channel speaker is given a job to do in filling the center hole. Alternatively, a Normal filter can be used and the Center channel can be unused or used for an unrelated purpose, such as traditional surround purpose or a channel dedicated to dialogue.

Using Normal Span allows the full expected volume on Front Left and Front Right to be preserved. Mixing sounds that are 100% correlated between left and right to center—a narrow range of sounds near center—into the physical center speaker of the 5.1 speaker set-up will fill a portion of the annular band between left and right, which can be referred to as the center hole, where the binaural signals with 100% correlate between left and right are 3 dB down. In specific embodiments, 100% correlated is met with at least 97%, at least 98%, or at least 99% correlated. Mixing sounds to the center speaker also "shakes the center speaker," fully utilizing all of the 5.1 speakers.

Figure 7:
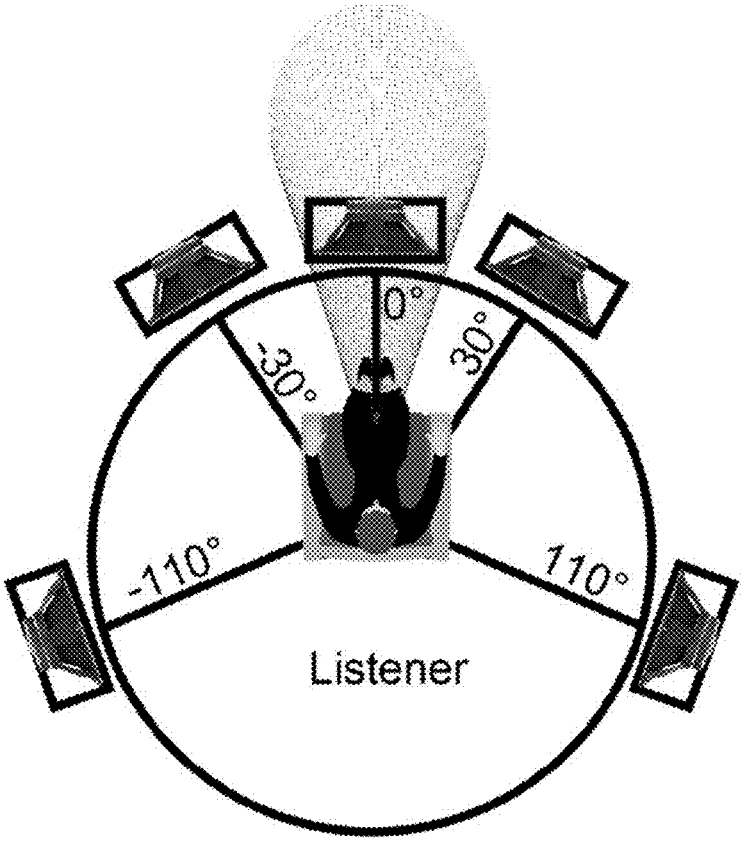
FIG. 7 shows an embodiment for providing 3D Sound with a 5.1 speaker set-up, where a BACCH-SP can be used for the front speakers of the 5.1 set-up, a BACCH-SP can be used for the rear speakers of the 5.1 set-up of the 5.1 set-up, and a Line-Out can be used for the Center speaker of the 5.1 set-up.

In this way, embodiments of the invention relate to a method and apparatus for providing 3D Sound with a 5.1 speaker set-up. In a specific embodiment, shown in FIG. 7, a BACCH-SP can be used for the front speakers of the 5.1 set-up, a BACCH-SP can be used for the rear speakers of the 5.1 set-up of the 5.1 set-up, and a Line-Out can be used for the Center speaker of the 5.1 set-up. A Line-Out can be used for the Sub speaker (subwoofer). A soundcard with 5.1 line out can be used to implement a specific embodiment.

Figure 16:
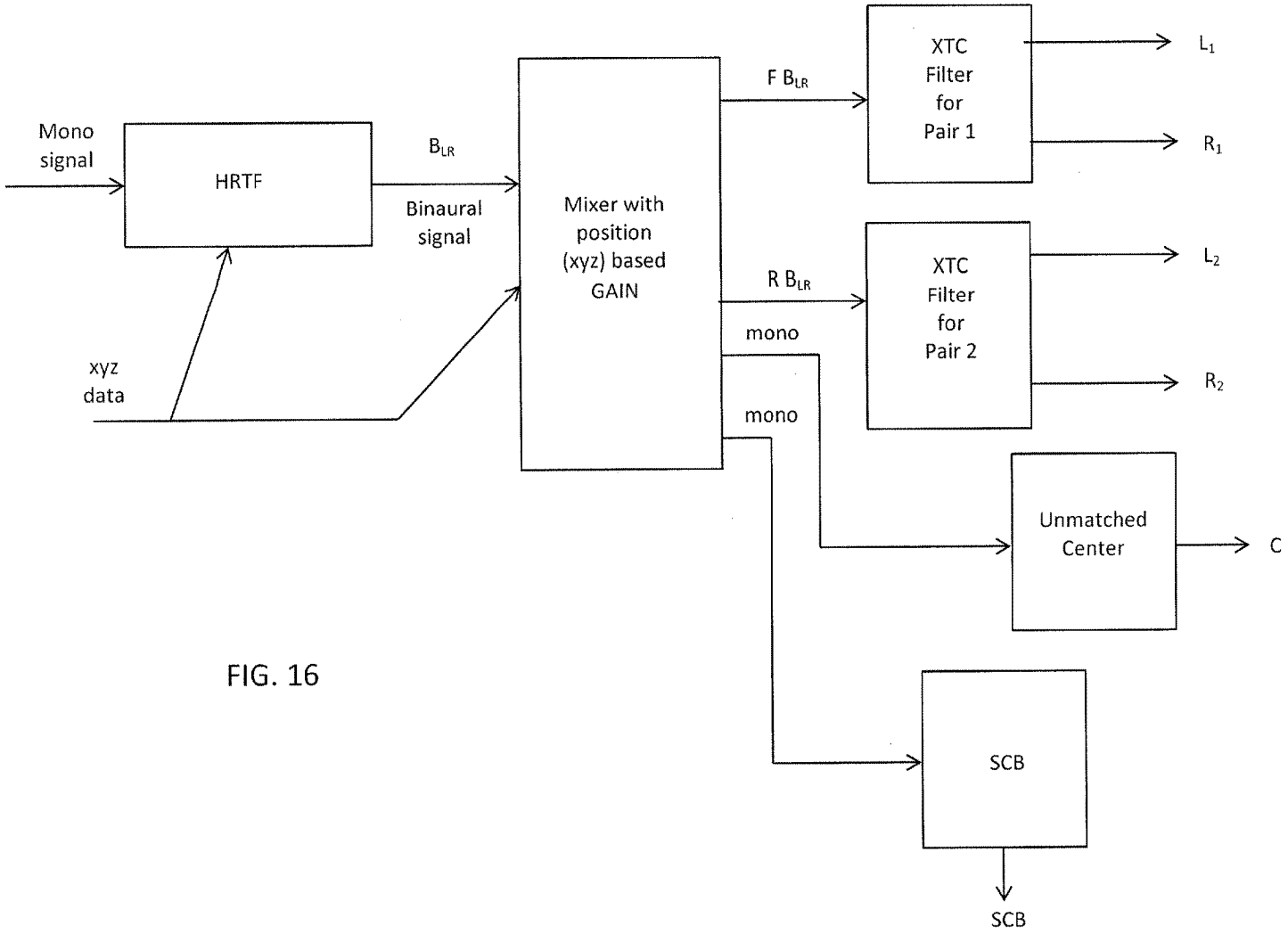
FIG. 16 shows a circuit for applying XTC filtering in accordance with an embodiment of the invention.

FIG. 16 shows an embodiment of a circuit that can be used to apply a pair of XTC filters to a corresponding pair of binaural signals that have been created by (i) applying an HRTF filter to a mono signal, where the HRTF filter takes into account of the xyz position of the sound and inputs the binaural signal outputted from the HTRF filter to a mixer with position (xyz) based GAIN, such that the mixer outputs the pair of binaural signals inputted to the pair of XTC filters. The outputted pairs of signals from the pair of XTC filters can then be inputted to corresponding pairs of speakers. In a specific embodiment, the outputted pairs of signals from the pair of XTC filters can then be inputted to corresponding pairs of left and right speakers. In specific embodiments, (1) the GAIN F and R can be amplitude gains for front (F) pairs of speakers and rear (R) pairs of speakers, (2) the GAIN T and M (instead of F and R) can be amplitude gains with bandpass filtering applied as well, for pair of tweeter (T) speakers and pair of midrange (M) speakers, and (3) the mixer with position (xyz) based GAIN can output three pairs of speakers (tweeters, midranges, and woofers), where the gains T, M, and W (instead of F and R) can have bandpass filtering applied as well.

Software can be used to send front and rear hemisphere sounds to different line outs, and mix between different line outs. Center channel and low frequency effects channel (LFE) can be mixed (the "0.1" subwoofer channel is treated as directionless and handled in the traditional method).

The subject approach to providing 3D Sound with a 5.1 set-up can be extended to any number of speakers, e.g., 7.1 set-up by partitioning the sphere into more segments, separating the segment for each pair of speakers, and using a crosstalk canceller for each speaker pair. When audio is in the area reproduced by that speaker pair, the crosstalk cancelled binaural audio is sent to that speaker pair. In a specific embodiment, the mixing of areas between speaker zones can be adjusted to maintain a smooth transition. Embodiments can be applied to overhead and off-level pairs of speakers.

In an embodiment extending the implementation to provide 3D Sound via a 7.1 set-up, Back Left and Back Right speakers can be moved to between 90 and 110 degrees back. Two new channels, Surround Back Left and Surround Back Right are added at 130 to 150 degrees back.

In a specific embodiment, a set of 3 HRTF's are created, one for the center speaker, one for the front pair of speakers, and one for the rear pair of speakers.

Referring to the MIT HRTF's (via KEMAR) elevation is a plane, where elevation 0 is the horizontal plane. Elevation −40 dips to your knees, elevation 90 is directly overhead. All of these planes pass through the center of your ears and the center of your head.

Using Elevation zero as an example, Azimuth 0 is directly ahead, Azimuth 90 is direct right, Azimuth −90 is direct left, and Azimuth 180° (or −180°) is directly back.

The MIT space has the convenient property that azimuth does not change with elevation—if the elevations planes are all smashed together vertically like a stacking cups, the azimuths do not change.

Figure 8:
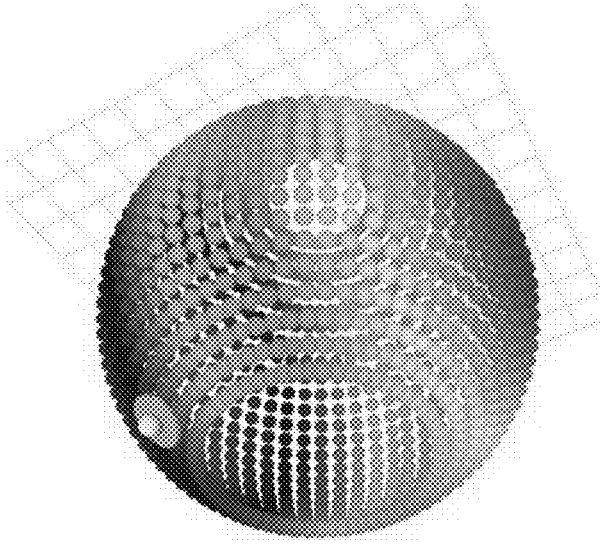
FIG. 8 shows planes of elevation with a ring of Azimuth point. One 90° elevation "north pole" point.

FIG. 8 (MIT Model) shows planes of elevation with a ring of Azimuth point. One 90° elevation "north pole" point. By adding a distance value all of three-dimensional space can be addressed. Other coordinate systems are commonly used to describe points in space.

Figure 1:
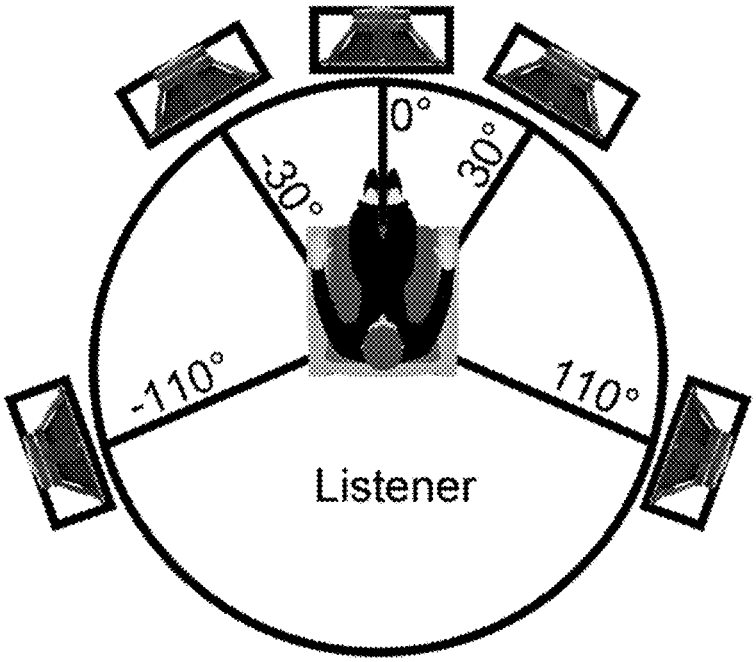
FIG. 1 shows a listener listening to surround sound with a speaker placement in accordance with ATSC A/52.
Figure 2:
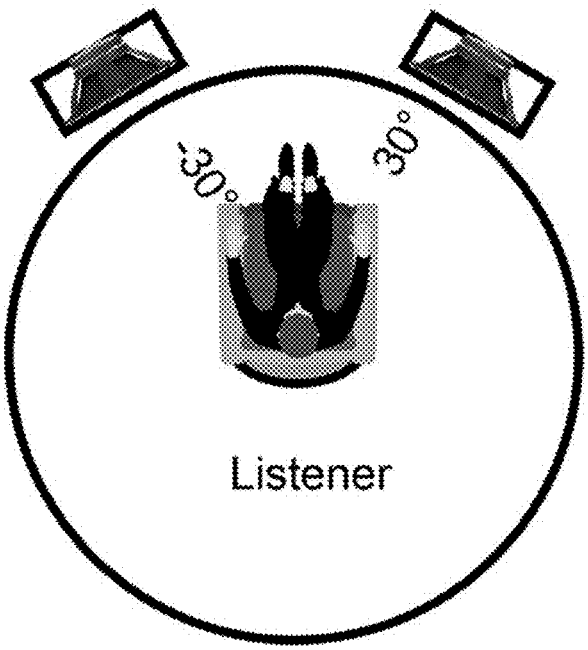
FIG. 2 shows a listener listening to binaural audio from signals from cross-talk canceller inputted to two (XTC) speakers in front of the listener.
Figure 3:
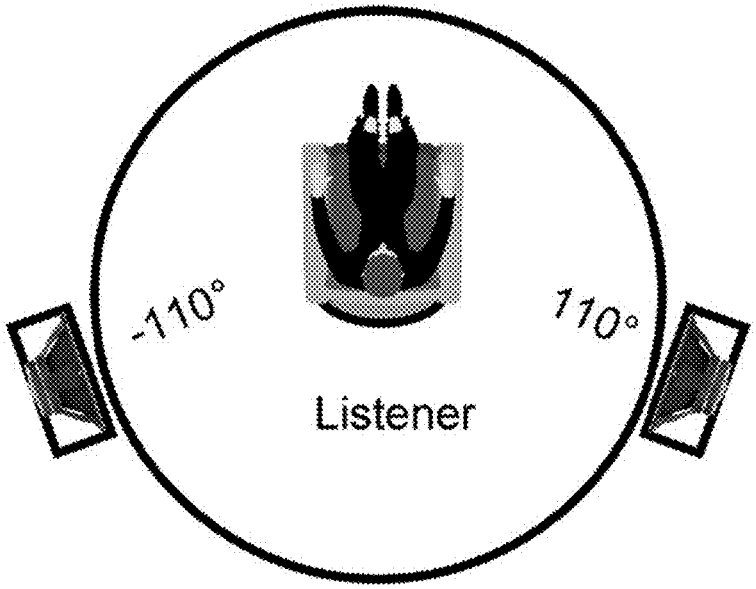
FIG. 3 shows a listener listening to binaural Audio with two XTC Speakers behind the listener.
Figure 4:
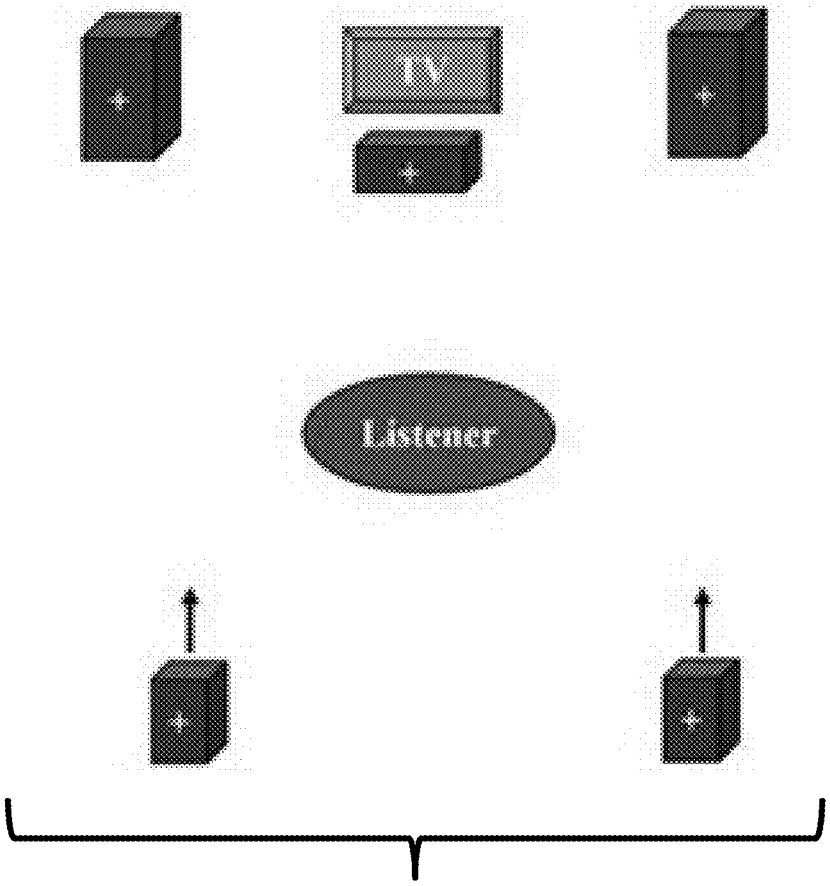
FIG. 4 shows a Typical surround sound speaker set-up (typical), where the Left and Right speakers are the only speakers with full size, full power, and full range; other channels (speakers) are special satellites and should be used for special effects and the speakers are positioned at non-uniform distances.
Figure 5:
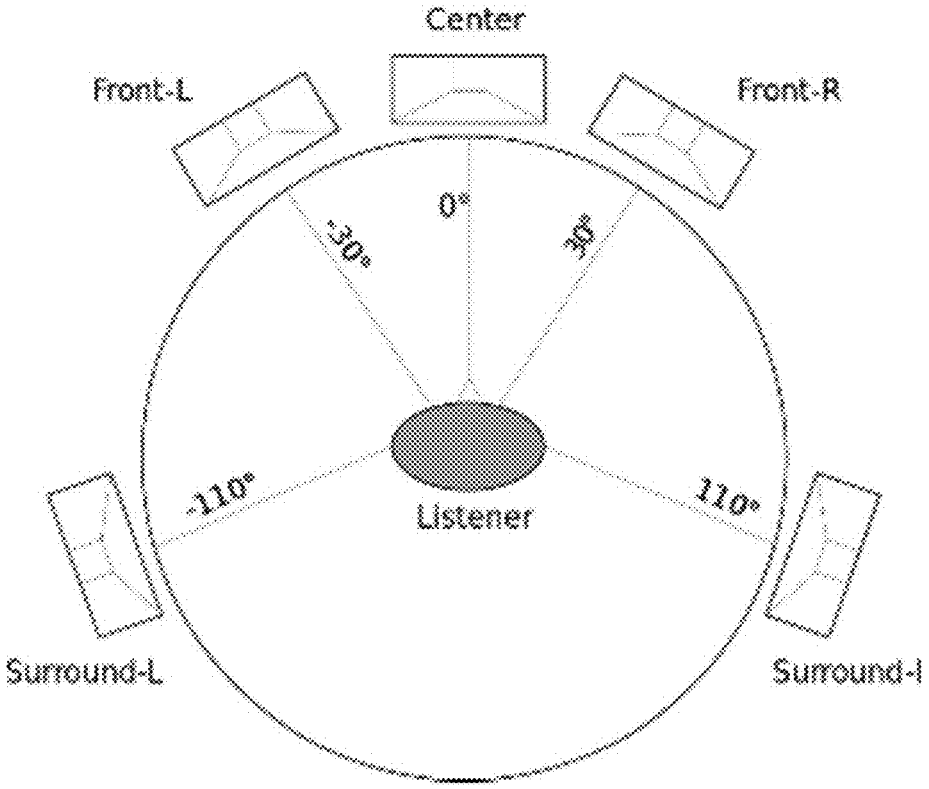
FIG. 5 shows with a Coherent surround sound speaker set-up (perfect) 5.1, where Identical Speakers are used, Identical Amplification is used, Identical Response of speakers is accomplished, and Uniform distances are implemented.

The physical speakers are at their standard locations in the elevation 0 plane (FIG. 1).

Figure 9:
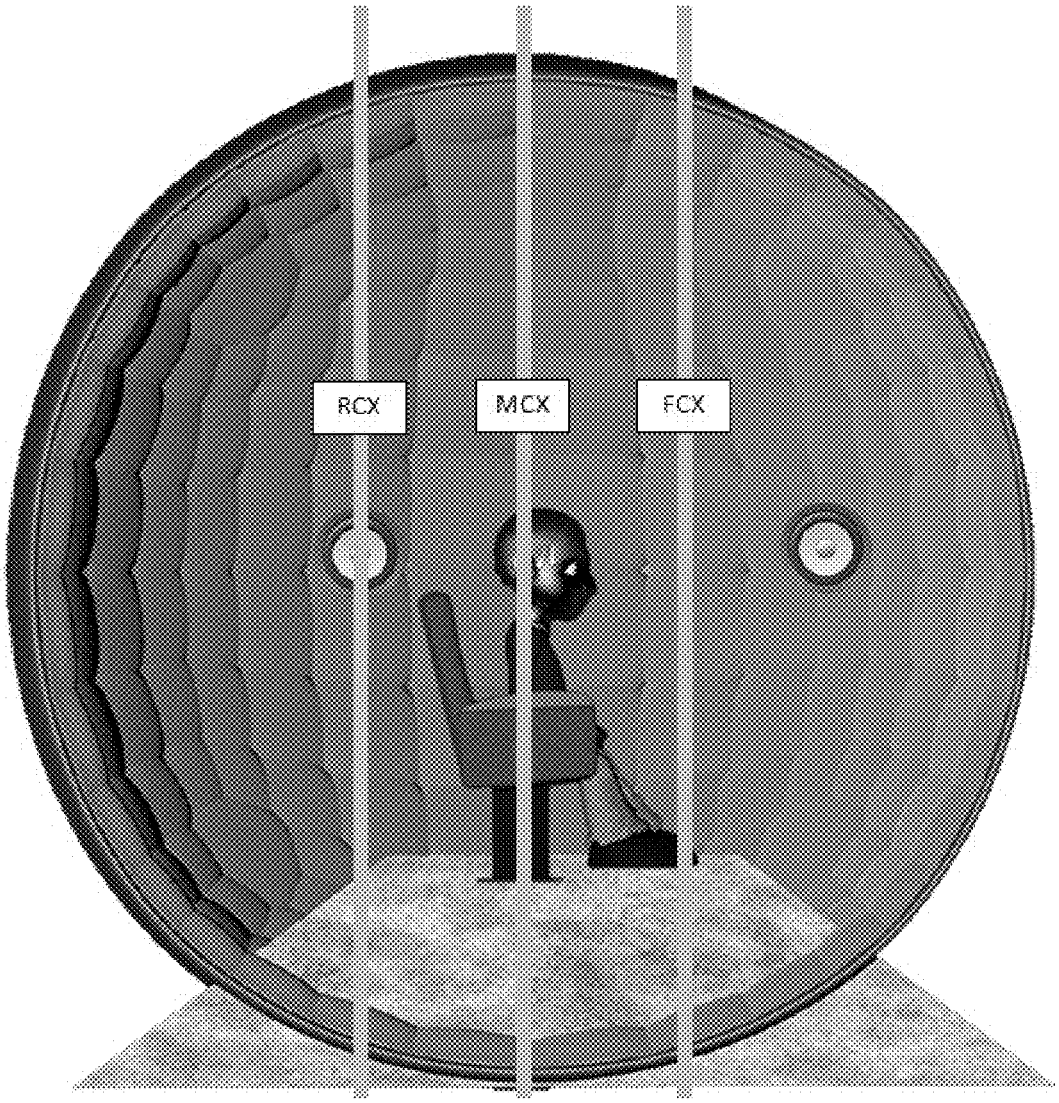
FIG. 9 shows a sphere around the listener vertically sliced, where the Mid Crossover Point (MCX), a.k.a. the 90 degree line, passes through the listener's ears, the Rear Crossover Point (RCX) is the point where the sound backward of the RCX should be panned completely to the rear speaker, and the Front Crossover Point (FCX) is the point where the sound forward of the FCX should be panned to the front speakers.

Because the speakers are in the horizontal plane, the sphere around the listener is vertically sliced as shown in FIG. 9, where the Mid Crossover Point (MCX), a.k.a. the 90 degree line, passes through the listener's ears.

The point of vertically slicing the sphere around the listener is that when or if the HRTF's between listener and recording mismatches or XTC mismatches, the sound collapses to the speakers that are either ahead or you or behind you. Ahead of you and behind you are distinct concepts, and the dividing line between them is hard left and hard right, in this space 90 degrees and −90 degrees.

The Rear Crossover Point (RCX) is the point where the sound backward of the RCX should be panned completely to the rear speaker. As the rear speaker is physically located at 110 degrees, RCX should not be farther back than 110 degrees.

The Front Crossover Point (FCX) is the point where the sound forward of the FCX should be panned to the front speakers.

An assumption is that symmetry is good. For the sake of symmetry, FCX should be as far forward as RCX is backward. RCX is at most 20 degrees from MCX, so FCX should be no farther forward than 70 degrees.

Table of Crossover Sets for specific embodiments

| Chop Set Name | FCX | MCX | RCX | Reasoning |
|---|---|---|---|---|
| Wide | 70 | 90 | 110 | Widest mixing zone that can be made with initial assumptions |
| Tight | 80 | 90 | 100 | A tighter mixing zone |
| Wall | 91 | 92 | 93 | 90 is all forward and the next point (95) is all backward |
| Slide | 90 | 100 | 110 | 90 is all forward and we reach all back by the time we get to the rear speaker |

Figure 10:
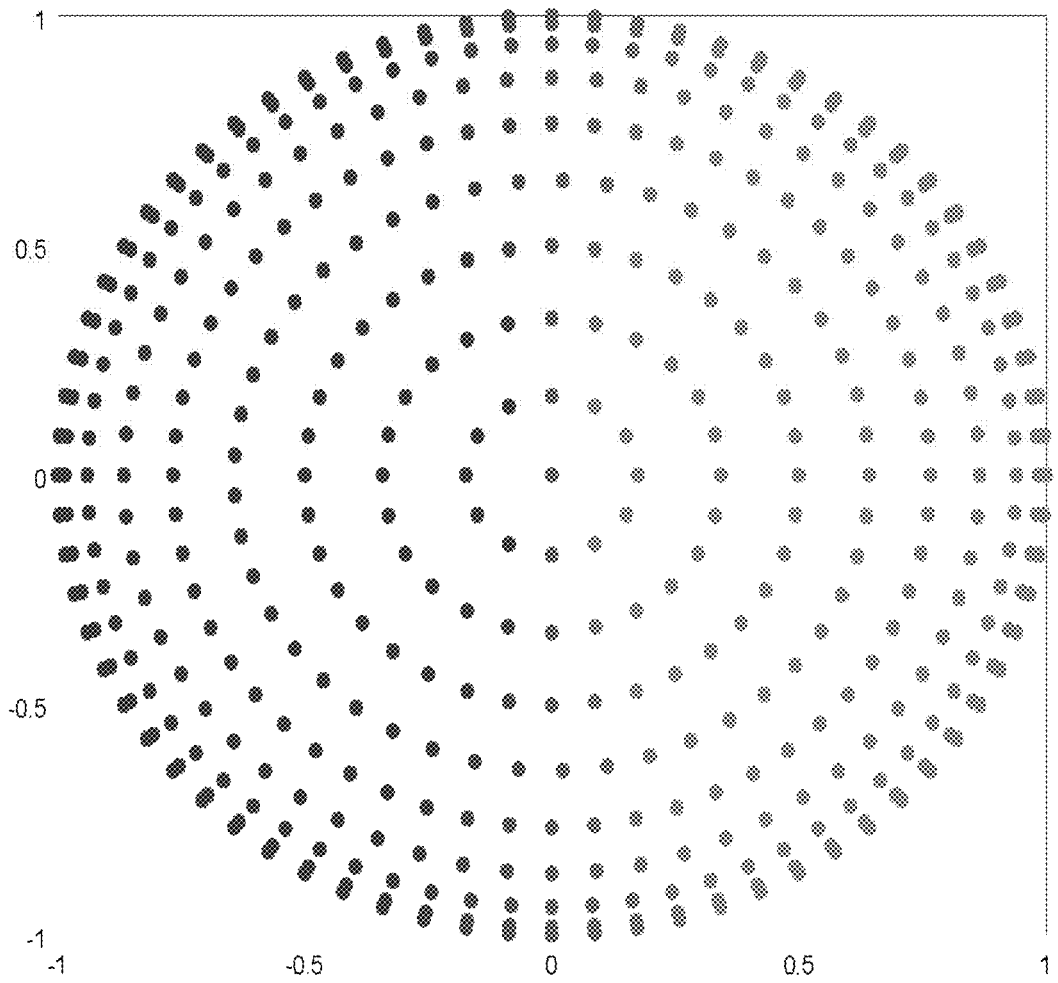
FIG. 10 shows the wide chop set.

FIG. 10 shows the wide chop set.

Figure 11:
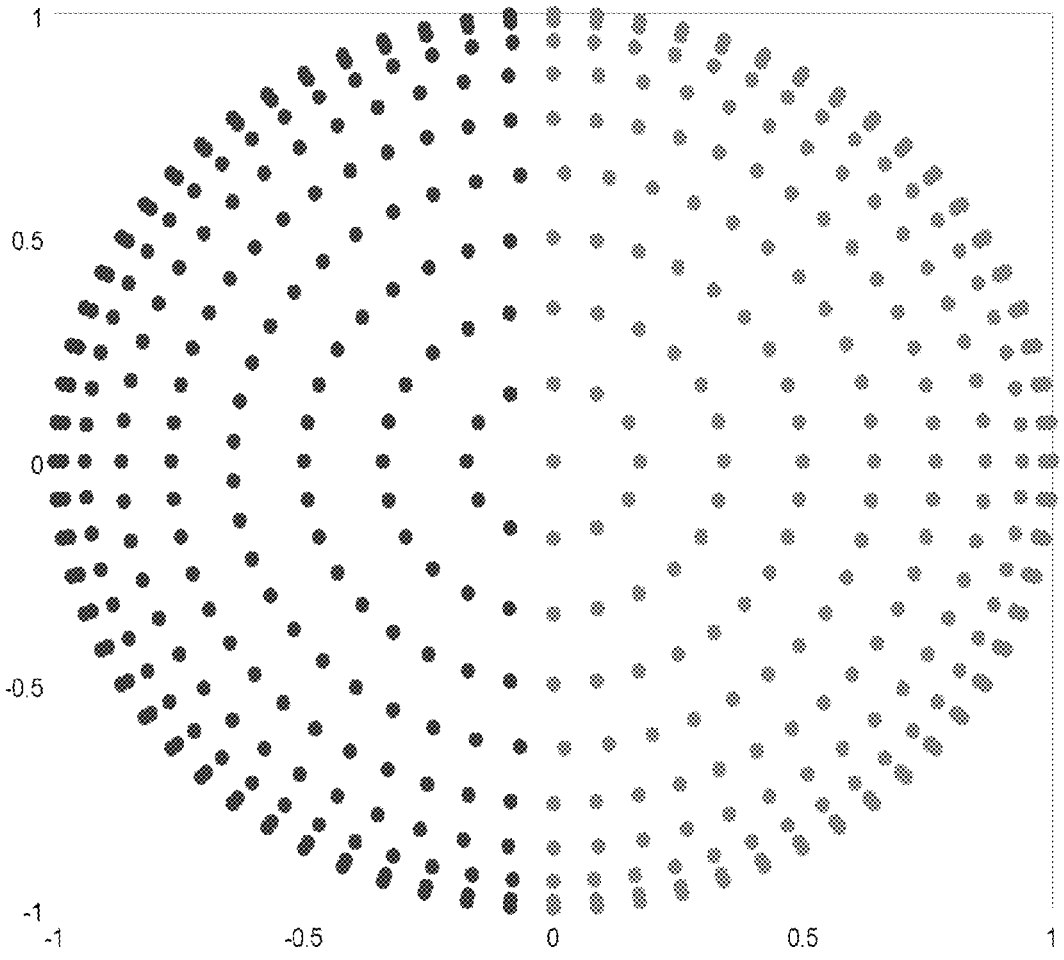
FIG. 11 shows the wall chop set.

FIG. 11 shows the wall chop set.

Figure 12:
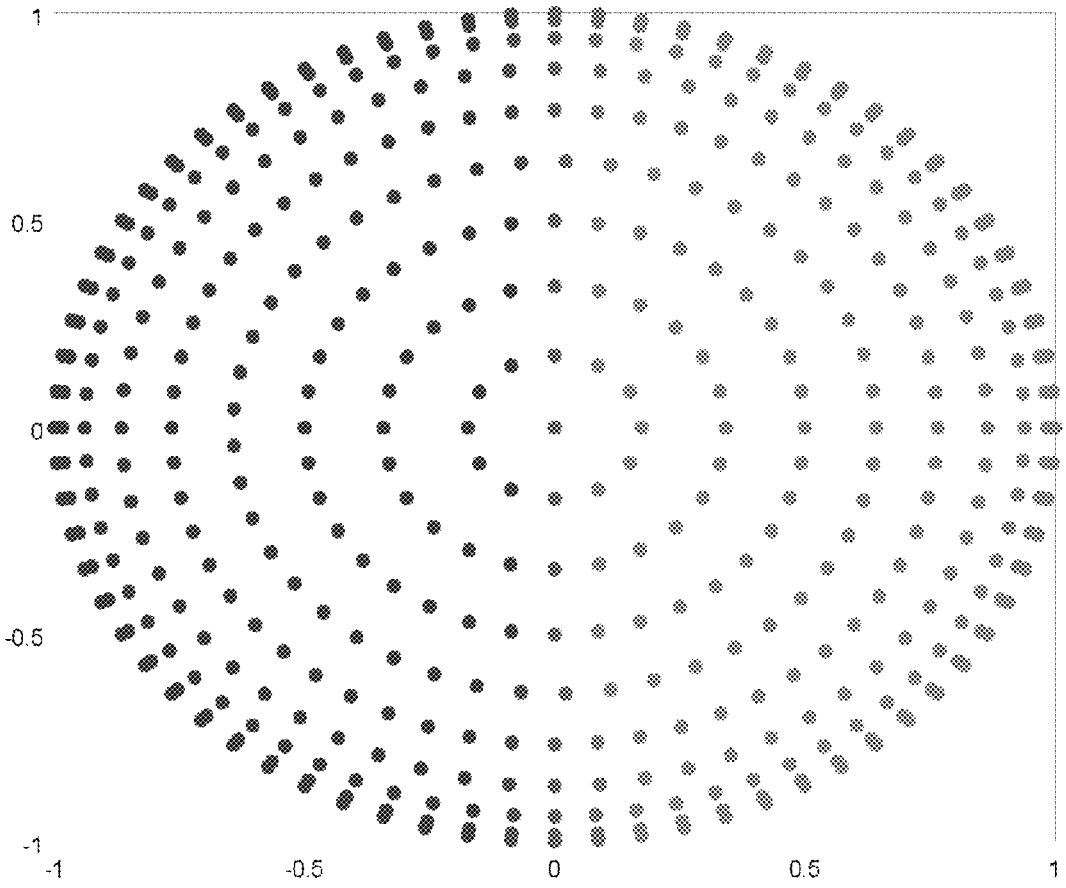
FIG. 12 shows the tight chop set.

FIG. 12 shows the tight chop set.

Figure 13:
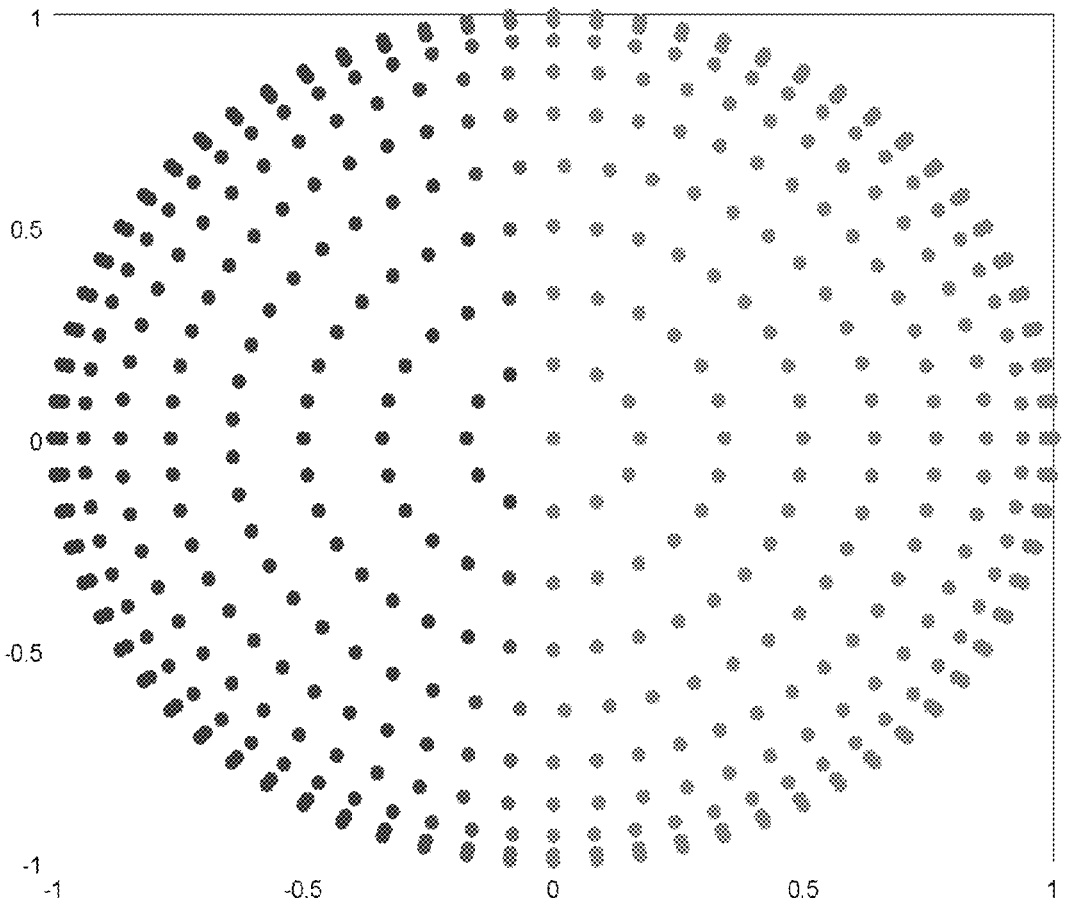
FIG. 13 shows the slide chop set.

FIG. 13 shows the slide chop set.

Figure 14:
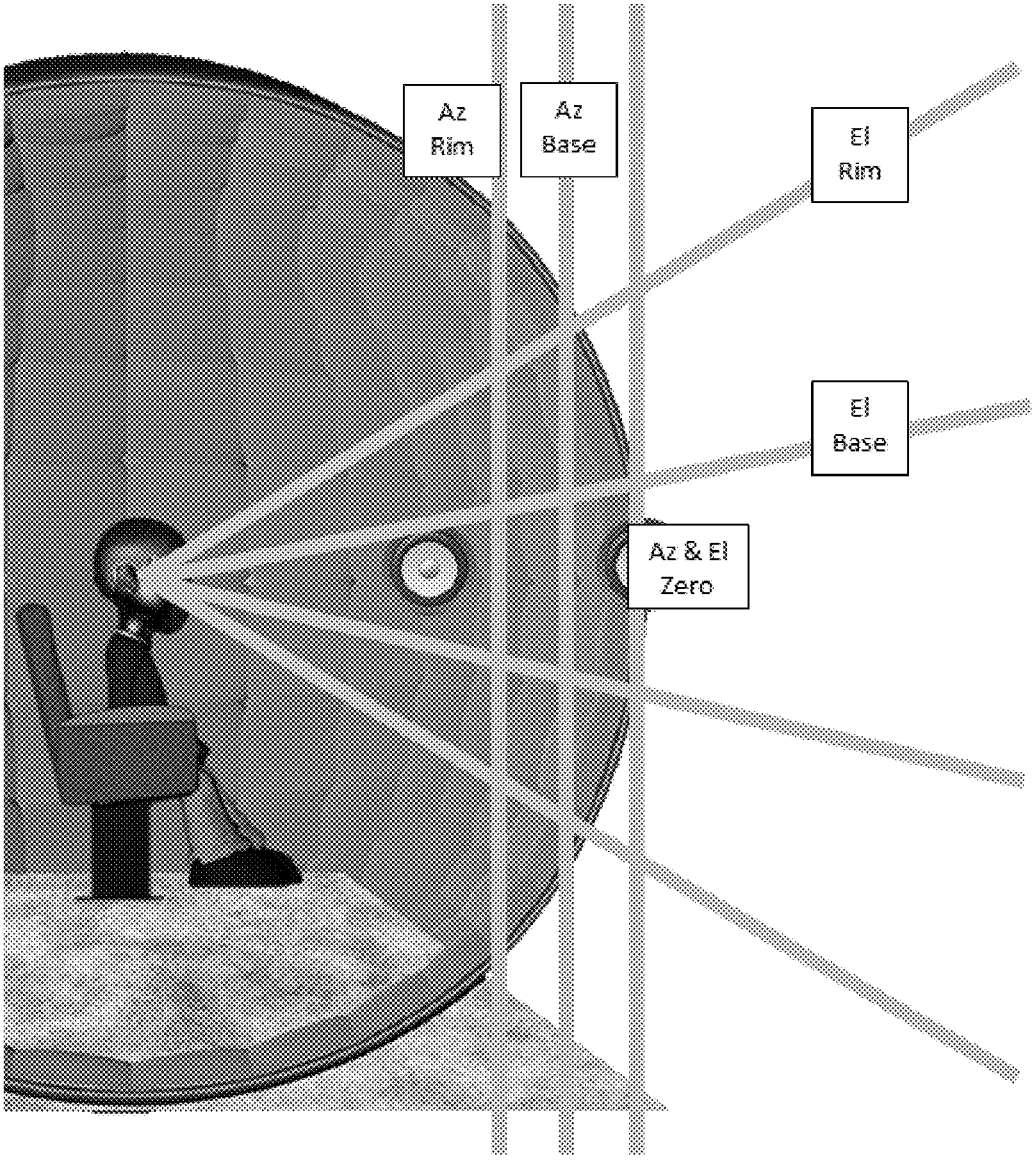
FIG. 14 shows the region of "The NoseCone."

FIG. 14 shows the region of "The NoseCone."

Figure 15:
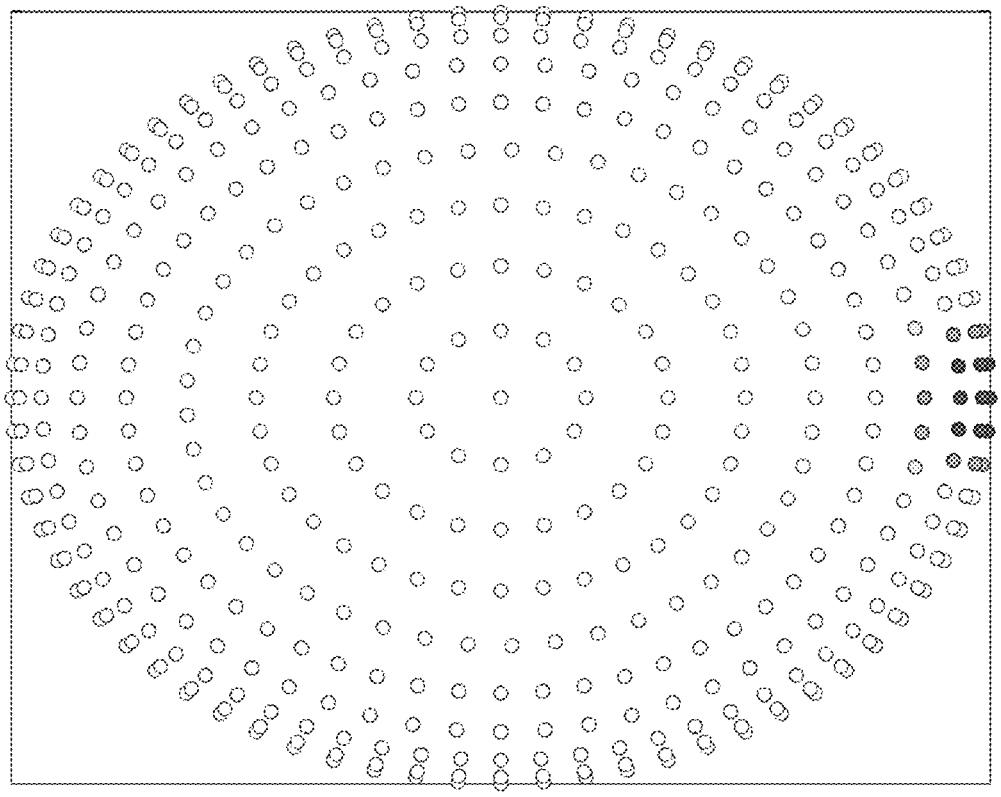
FIG. 15 shows the "The NoseCone" set.

FIG. 15 shows the "The NoseCone" set.

Under a crater model there is a "center hole" where binaural signals with 100% correlation between left and right are 3 dB down. This area can be thought of like a crater, it has a flat floor at the bottom of a hole 3 dB deep. The bottom edges of this flat hole are the −3 dB base. A smooth slope from the bottom to the top is desired. The top edge, where center sound stops, is the rim. The width of this crater is quite narrow.

The height of the crater is a different matter. The 100% correlation can happen anywhere in the vertical plane that slices the user in half left-to-right, and it is clearly impractical to send power to center for overhead and behind signals. The crater height is tall, but not so tall as to detract from the sensation of actual overhead signals processed with HRTFs.

Impulse Reponses

Signals from in front and overhead are correctly positioned with the HRTF copies that are crosstalk cancelled and sent to front left and front right speakers. The goal is just to fill the center hole, not to detract from those positions. The front speaker cannot be crosstalk cancelled by itself, it has an unmistakable cue that matches its physical position. In an embodiment, the array can be replaced with a scalar value at its first position, which is appropriate if all the HRTF's are zero-phase filters. In another embodiment, in order to maintain the pure delay part of the HRTF's, the HRTF's are replaced with a scalar value at the location of their peak.

Table of Nosecone Sets for specific embodiments

| Chop Set Name | Az base (AB) | Az Rim (AR) | El base (EB) | El rim (ER) | Reasoning |
|---|---|---|---|---|---|
| First | 5 | 15 | 20 | 40 | First, a narrow width, a modest height |
| Zero | 5 | 15 | 20 | 40 | Same area as First, but with scalars at the start of the array instead of at the peak location |

In an embodiment to implement 3D Sound with 5.1 set-up,

A BACCH-SP can be used for the front speakers,

A BACCH-SP can be used for the rear speakers,

A Line-Out can be used for Center,

A Line-Out can be used for Sub,

A soundcard with 5.1 line out can be used.

In an embodiment, software can be used to send front and rear hemisphere to different line outs, such as front speakers and rear speakers, respectively.

In another embodiment, software can be used to send sounds forward of FCX to front speakers, send sounds rear of RCX to rear speakers, and mix sounds between RCX and FCX to front speakers and rear speakers line outs. In this way, sounds between RCX and FCX can be implemented using the front and rear speakers where sounds near RCX can send a larger portion to the rear speakers, sounds art MCX can send 50-50 to front and rear speakers, and sounds near FCX can send a larger portion to the front speakers. In a specific embodiment, this can be a linear transition.

Center and LFE mix (the "0.1" subwoofer channel can be treated as directionless and handled in the traditional method). A single speaker is often composed of multiple speakers, each reproducing a subset of the audible frequency band. These speakers are often combined into one speaker, even if they contain a subwoofer, a midrange, and a tweeter. The "0.1" makes it clear that there can be a different number of subwoofers than there are other loudspeakers, and that the subwoofer can be located in a different location. This is also true of midranges and tweeters. There can be a different number of midranges and tweeters in different locations, and their XTC filters can be designed separately, each responsible for generating crosstalk cancelled sound in their part of the audio spectrum.

This method of providing 3D sound for Surround Configurations should not be confused with the Optimal Source Distribution (OSD) method of providing 3D Sound through loudspeakers. In the method embodied herein, the speaker positions are constrained, either by the standard configurations already in use in the surround sound industry, by user placement, or by physical placement of a designer, such as the loudspeaker position chosen for an automotive cabin, and the XTC filters are then designed such that a 3D Sound listening experience is generated for the user. In the OSD method the location of the listener, the number of speaker pairs, and the required frequency response of each speaker pair is constrained by the desired quality of the results and the capabilities of the OSD filters and the entire system must be constructed to meet the constraints of the OSD method 719 190 006.

Embodiments can be extended to any number of speakers. The sphere can be partitioned into more segments, separating the segment for each pair of speakers, e.g., to extend 5.1 to 7.1.

A crosstalk canceller can be created for the speaker pair of the 7.1 set-up.

When audio is in the area reproduced by that speaker pair, send the crosstalk cancelled binaural audio to that speaker pair The mixing areas between speaker zones can be adjusted to maintain a smooth transition for sounds between two CX's Embodiments can be applied to overhead and off-level pairs of speakers.

Extending 5.1 to 7.1, Back Left and Back Right move between 90 and 110 degrees back, and two new channels, Surround Back Left and Surround Back Right, are added at 130 to 150 degrees back.

The use of 5/7/more speakers has been standardized in ITU-R BS.775 https://www.itu.int/dm_spubrec/itu-r/rec/bs/R-REC-BS.775-3-2012084-I!!PDF-E.pdf "Multichannel Stereophonic sound system with and without accompanying picture ITU-R BS.775-3 (August 2012) (Radiocommunication Sector of International Telecommunication Union BS.775-3 (OB/2012)) and in "Multichannel sound technology in home and broadcasting applications" IT4-R B5-2159-4 (May 2012), both of which are incorporated by reference herein in their entirety.

EMBODIMENTS

Embodiment 1

A system for listening to binaural audio through a plurality of speakers by dividing the speakers into pairs, generating a Crosstalk Cancellation Filter for each pair, and distributing the binaural audio among the speaker pairs.

Embodiment 2

The system according to Embodiment 1, wherein the plurality of speakers is a surround sound system.

Embodiment 3

The system according to Embodiment 1, wherein the plurality of speakers is a 5.1 surround sound system in which the speakers are placed in approximately the ITU-R BS 775 configuration of a circle at the level of the listener, center speaker forward of the listener at zero degrees on the circle, left and right speakers at +/−30 degrees, and surround speakers at +/−110 degrees.

Embodiment 4

The system according to Embodiment 1, wherein the plurality of speakers is a 5.1 surround sound system in which the speakers are placed in a variation of the ITU-R BS 775 configuration in which the height is ignored, the center speaker is forward of the listener at zero degrees on the circle or missing, left and right speakers are at the "music" position of +/−30 degrees or the "cinema" position of +/−22 degrees, and the surround speakers at +/−110 degrees or the popular variation of +/−135 degrees.

Embodiment 5

The system according to Embodiment 1, wherein the plurality of speakers is a 5.1 surround sound system, 6.1 surround sound system, 7.1 surround sound system, 10.2, 22.2 or any count of surround sound loudspeakers in any configuration.

Embodiment 6

The system according to Embodiment 1, wherein the Crosstalk Cancellation Filter uses BACCH 3D Sound technology invented at Princeton University.

Embodiment 7

The system according to Embodiment 1, wherein there is a center speaker that is not matched as part of a pair or a plurality of speakers in the center plane equidistant to both ears of the listener, in which the unmatched speaker or speakers are unused or used for non-binaural content.

Embodiment 8

The system according to Embodiment 1, wherein there is a center speaker that is not matched as part of a pair or a plurality of speakers in the center plane equidistant to both ears of the listener, in which the unmatched speaker or speakers are unused to contribute to the effect of sound coming directly or within a few degrees of the direction of themselves, and the energy of the 3D sound signal from the other speaker pairs is reduced commensurately in an volumetric area around the unpaired speaker or speakers.

Embodiment 9

The system according to Embodiment 1, wherein there is a center speaker that is not matched as part of a pair or a plurality of speakers because it is a subwoofer used for low frequency effects.

Embodiment 10

A system and method for listening to binaural audio through a plurality of speakers by dividing the speakers into groups, generating a Crosstalk Cancellation Filter for each group, and distributing the binaural audio among the speaker groups.

Embodiment 11

The system according to Embodiment 10, wherein the plurality of speakers consist of a pair of loudspeakers that excite only a portion of the audible audio frequency range.

Embodiment 12

The system according to Embodiment 10, wherein the group of speakers consist of one set of speakers that excites all or a portion of the audible audio frequency range, and one set of speakers that excites all or an overlapping but not identical portion of the audible frequency range.

Embodiment 13

The system according to Embodiment 10, wherein the group of speakers consist of the speakers in an automotive cabin.

Embodiment 14

A system for placing a binaural audio signal onto a plurality of pairs on crosstalk cancelled loudspeakers.

Embodiment 15

The system according to Embodiment 14, wherein the portion of the signal directed to each loudspeaker pair is determined by the intended direction of the audio signal and the position of each loudspeaker pair.

Embodiment 16

The system according to Embodiment 14, wherein the portion of the signal directed to each loudspeaker pair is determined by the intended direction of the audio signal and the position of each loudspeaker pair by starting with the desired perceived azimuthal angle of the audio source and comparing it to the azimuthal angles of each of the speakers.

Embodiment 17

The system according to Embodiment 14, wherein the portion of the signal directed to each loudspeaker pair is determined by the intended direction of the audio signal and dividing a circle on the level with the listener into target groups of azimuthal angles in which each pair of speakers is intended to operate.

Embodiment 18

The system according to Embodiment 14, wherein the portion of the signal directed to each loudspeaker pair is determined by the x,y position of the audio signal and dividing a space on the level with the listener into regions on a plane in which each pair of speakers is intended to operate.

Embodiment 19

The system according to Embodiment 14, wherein the portion of the signal directed to each loudspeaker pair is determined by the intended direction of the audio signal and the position of each loudspeaker pair by starting with the desired perceived azimuthal and elevation angle of the audio source and comparing it to the azimuthal and elevation angle of each of the speakers.

Embodiment 20

The system according to Embodiment 14, wherein the portion of the signal directed to each loudspeaker pair is determined by the intended direction of the audio signal and dividing a sphere around the listener into target groups of spherical sectors in which each pair of speakers is intended to operate.

Embodiment 21

The system according to Embodiment 14, wherein the portion of the signal directed to each loudspeaker pair is determined by the x,y,z position of the audio signal or equivalent 3-space signal in any coordinate system and dividing 3-space into regions in which each pair of speakers is intended to operate.

Embodiment 22

The system according to Embodiment 14, wherein the portion there are crossover regions between each pair of loudspeakers in which the binaural signal is mixed proportionally into each region.

Embodiment 23

The system according to Embodiment 14, wherein the portion there are crossover regions between each pair of loudspeakers in which the binaural signal is mixed proportionally into each region using constant total power mixing.

Embodiment 24

The system according to Embodiment 14, wherein the system is acting on an arbitrarily large number of source signals, each with unique position data.

Embodiment 25

The system according to Embodiment 14, wherein the system is acting on an arbitrarily large number of source signals, each with unique position data, and the positions are changing as a function of time such that the processing from one time period and position needs to be mixed into the processing for the next time period and position in order to prevent discontinuity in the output signal.

Embodiment 26

The system according to Embodiment 14, wherein certain regions around unmatched speakers are rendered as a combination of a crosstalk cancelled signal to a speaker pair and an unmatched signal to the unmatched speaker.

Embodiment 27

The system according to Embodiment 14, wherein certain regions of the frequency spectrum are divided among crosstalk cancelled speaker pairs in a different manner than other regions of the frequency spectrum targeted at other speaker pairs.

Aspects of the invention, such as implementing filters and mixing signals, may be described in the general context of computer-executable instructions, such as program modules, being executed by a computer. Generally, program modules include routines, programs, objects, components, data structures, etc., that perform particular tasks or implement particular abstract data types. Moreover, those skilled in the art will appreciate that the invention may be practiced with a variety of computer-system configurations, including multiprocessor systems, microprocessor-based or programmable-consumer electronics, minicomputers, mainframe computers, and the like. Any number of computer-systems and computer networks are acceptable for use with the present invention.

Specific hardware devices, programming languages, components, processes, protocols, and numerous details including operating environments and the like are set forth to provide a thorough understanding of the present invention. In other instances, structures, devices, and processes are shown in block-diagram form, rather than in detail, to avoid obscuring the present invention. But an ordinary-skilled artisan would understand that the present invention may be practiced without these specific details. Computer systems, servers, work stations, and other machines may be connected to one another across a communication medium including, for example, a network or networks.

As one skilled in the art will appreciate, embodiments of the present invention may be embodied as, among other things: a method, system, or computer-program product. Accordingly, the embodiments may take the form of a hardware embodiment, a software embodiment, or an embodiment combining software and hardware. In an embodiment, the present invention takes the form of a computer-program product that includes computer-useable instructions embodied on one or more computer-readable media.

Computer-readable media include both volatile and non-volatile media, transient and non-transient media, removable and nonremovable media, and contemplate media readable by a database, a switch, and various other network devices. By way of example, and not limitation, computer-readable media comprise media implemented in any method or technology for storing information. Examples of stored information include computer-useable instructions, data structures, program modules, and other data representations. Media examples include, but are not limited to, information-delivery media, RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data momentarily, temporarily, or permanently.

The invention may be practiced in distributed-computing environments where tasks are performed by remote-processing devices that are linked through a communications network. In a distributed-computing environment, program modules may be located in both local and remote computer-storage media including memory storage devices. The computer-useable instructions form an interface to allow a computer to react according to a source of input. The instructions cooperate with other code segments to initiate a variety of tasks in response to data received in conjunction with the source of the received data.

The present invention may be practiced in a network environment such as a communications network. Such networks are widely used to connect various types of network elements, such as routers, servers, gateways, and so forth. Further, the invention may be practiced in a multi-network environment having various, connected public and/or private networks.

Communication between network elements may be wireless or wireline (wired). As will be appreciated by those skilled in the art, communication networks may take several different forms and may use several different communication protocols. And the present invention is not limited by the forms and communication protocols described herein.

The examples and embodiments described herein are for illustrative purposes only and various modifications or changes in light thereof will be apparent to persons skilled in the art and are included within the spirit and purview of this application. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

All patents, patent applications, provisional applications, and publications referred to or cited herein (including those in the "References" section) are incorporated by reference in their entirety, including all figures and tables, to the extent they are not inconsistent with the explicit teachings of this specification.

REFERENCES 1. http://www.princeton.edu/3D3A/Projects.html
2. https://www.grammy.org/files/pages/SurroundRecommendations.pdf
3. https://www.itu.int/dms_pubrec/itu-r/rec/bs/R0REC-BS.775-3-201208-I!!PDF-E.pdf
4. https://www.itu.int/dms_pub/itu-r/opb/rep/R-REP-BS.2159-4-2012-PDF-E.pdf

References for the Optimal Source Distribution Method

5. T. Takeuchi and P. A. Nelson, J. Acoust. Soc. Am. 112, 2786 (2002).
6. P. A. Nelson and J. F. W. Rose, J. Acoust. Soc. Am. 118, 193 (2005).
7. T. Takeuchi and P. A. Nelson, J. Audio Eng. Soc. 5, 981 (2007).

The invention claimed is:

1. A system for listening to binaural audio through a plurality of speakers having at least two pairs of speakers, comprising: at least two crosstalk cancellation filters, wherein the at least two crosstalk cancellation filters receive a corresponding at least two binaural signals, and output a corresponding at least two pairs of speaker signals, and wherein at least one binaural signal of the at least two binaural signals is a front binaural signal and at least one other binaural signal of the at least two binaural signals is a read binaural signal; and a plurality of speakers, wherein the plurality of speakers comprises: at least two pairs of speakers, wherein the at least two pairs of speakers signals are input to the corresponding at least two pairs of speakers of the plurality of speakers; and a center speaker, wherein the center speaker is not matched as part of a pair of speakers of the at least two pairs of speakers of the plurality of speakers, wherein the center speaker is in a center plane equidistant to both ears of a listener, and wherein the center speaker is used to contribute to an effect of sound coming directly or within a few degrees of a direction of the center speaker, and an energy of a 3D sound signal from the at least two pairs of speakers is reduced commensurately in a volumetric area around the center speaker.

2. The system according to claim 1, wherein the plurality of speakers is a surround sound system.

3. The system according to claim 1, wherein the plurality of speakers is a 5.1 surround sound system in which the speakers of the plurality of speakers are placed approximately an ITU-R BS 775 configuration of a circle at a level of the listener, with: the center speaker forward of the listener at zero degrees on the circle; left and right speakers at +/−30 degrees; and surround speakers at +/−110 degrees.

4. The system according to claim 1, wherein the plurality of speakers is a 5.1 surround sound system in which the speakers of the plurality of speakers are placed in a variation of an ITU-R BS 775 configuration of a circle in which: a height is ignored; the center speaker is forward of the listener at zero degree on the circle; left and right speakers are a music position of +/−30 degrees or a cinema position of +/−22 degrees; and surround speakers are at +/−110 degrees or +/−135 degrees.

5. The system according to claim 1, wherein the plurality of speakers is: a 5.1 surround sound system; a 6.1 surround sound system; a 7.1 surround sound system; a 10.2 surround sound system; or a 22.2 surround sound system.

6. The system according to claim 1, wherein the at least two crosstalk cancellation filters use BACCH 3D Sound technology.

7. The system according to claim 1, wherein each pair of speaker signals of the at least two pairs of speaker signals excites only a corresponding range of a corresponding at least two ranges of audio frequencies when applied to the corresponding pair of speakers of the at least two pairs of speakers.

8. The system according to claim 7, wherein the plurality of speakers comprises a pair of loudspeakers that excite only a portion of an audible audio frequency range.

9. The system according to claim 7, wherein the at least two pairs of speakers of the plurality of speakers comprise a first pair of speakers that excites a first portion of an audible audio frequency range, and a second pair of speakers that excites a second portion of the audible audio frequency range, such that the second portion of the audible audio frequency range overlaps, but is not identical to, the first portion of the audible frequency range.

10. The system according to claim 7, wherein the at least two pairs of speakers of the plurality of speakers comprise at least two pairs of speakers in an automotive cabin.

11. A system for placing a binaural audio signal onto a plurality of pairs of speakers, comprising: a mixer configured to receive an input binaural signal and output at least two binaural signals, wherein a first binaural signal of the at least two binaural signals is a front binaural signal and a second binaural signal of the at least two binaural signals is a rear binaural signal; a corresponding at least two crosstalk cancellation filters configured to receive the at least two binaural signals and to create a corresponding at least two pairs of speaker signals, such that the at least two pairs of speaker signals are configured to be inputted to a corresponding at least two pairs of speakers, wherein a corresponding portion of the input binaural signal directed to each pair of speakers of the at least two pairs of speakers is determined by: (i) an intended direction of the input binaural signal and a corresponding position of each pair of speakers of the at least two pairs of speakers; (ii) an intended direction of the input binaural signal and dividing: (a) a circle on a level with the listener into target groups of azimuthal angles in which each pair of speakers of the at least two pairs of speakers is intended to operate; or (b) a sphere around the listener into target groups of spherical sectors in which each pair of speakers of the at least two pairs of speaker is intended to operate; (iii) and x,y position of the input binaural signal and dividing a space on a level with the listener into regions on a plane in which each pair of speakers of the at least two pairs of speakers is intended to operate; or (iv) an x,y,z position of the input binaural signal or equivalent 3D-space signal in any coordinate system and dividing 3D-space into regions in which each pair of speakers of the at least two pairs of speakers is intended to operate; a center speaker, wherein the center is not matched as part of a pair of speakers of the at least two pairs of speakers of the plurality of speakers, wherein the center speaker is in the center plane equidistant to both ears of a listener, and wherein the center speaker is used to contribute to an effect of sound coming directly or within a few degrees of the direction of the center speaker, and an energy of a 3D sound signal from the at least two pairs of speakers is reduced commensurately in a volumetric area around the center speaker.

12. The system according to claim 11, wherein the corresponding portion of the input binaural signal directed to each: of speakers of the at least two pairs of speakers is determined by: (i) the intended direction of the input binaural signal and the corresponding position of each pair of speakers of the at least two pairs of speakers.

13. The system according to claim 11, wherein the corresponding portion of the input binaural signal directed to each pair of speakers of the at least two pairs of speakers is determined by: (i) the intended direction of the input binaural signal and the corresponding position of each pair of speakers of the at least two pairs of speaker, by: (A) starting with a desired perceived azimuthal angle of the input binaural signal and comparing the desired perceived azimuthal angle of the input binaural signal to corresponding azimuthal angles of each of the speakers of the at least two pairs of speakers; or (B) starting with a desired perceived azimuthal and elevation angle of the input binaural signal and comparing the desired perceived azimuthal and elevation angle of the input binaural signal to the azimuthal and elevation angle of each of the speakers of the at least two pairs of speakers.

14. The system according to claim 11, wherein the corresponding portion of the input binaural signal directed to each pair of speakers of the at least two pairs of speakers is determined by: the intended direction of the input binaural signal and dividing: (a) the circle on the level with the listener into target groups of azimuthal angles in which each pair of speakers of the at least two pairs of speakers is intended to operate; or (b) the sphere around the listener into target groups of spherical sectors in which each pair of speakers of the at least two pairs of speakers is intended to operate.

15. The system according to claim 11, wherein there are crossover regions between each pair of speakers of the at least two pairs of speakers in which the input binaural signal is mixed proportionally into each crossover region.

16. The system according to claim 11, wherein there are crossover regions between each pair of speakers of the at least two pairs of speakers in which the input binaural signal is mixed proportionally into each crossover region using constant total power mixing.

17. The system according to claim 11, wherein the system is acting on an arbitrarily large number of source signals, each with unique position data.

18. The system according to claim 11, wherein the system is acting on an arbitrarily large number of source signals, each with unique position data, and the positions are changing as a function of time such that the processing from one time period and position needs to be mixed into the processing for a next time period and position in order to prevent discontinuity in the output signal.

19. The system according to claim 11, wherein certain regions around the center speaker are rendered as a combination of a crosstalk cancelled signal to a pair of speakers of the at least two pairs of speakers and an unmatched signal to the center speaker.

20. The system according to claim 11, wherein certain regions of an audible frequency spectrum are divided among crosstalk cancelled pairs of speakers of the at least two pairs of speaker in a different manner than other regions of the audible frequency spectrum targeted at other pairs of speakers of the at least two pairs of speaker.

* * * * *